US009805859B1

(12) United States Patent
Berry et al.

(10) Patent No.: US 9,805,859 B1
(45) Date of Patent: Oct. 31, 2017

(54) MAGNETIC COMPONENT WITH ELEVATED BOBBIN

(71) Applicant: Universal Lighting Technologies, Inc., Madison, AL (US)

(72) Inventors: Travis Berry, Madison, AL (US); Brandon Dyer, Huntsville, AL (US); Donald Folker, Madison, AL (US); Theodore Kluska, Madison, AL (US); Mike LeBlanc, Huntsville, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 153 days.

(21) Appl. No.: 14/572,877

(22) Filed: Dec. 17, 2014

Related U.S. Application Data

(60) Provisional application No. 61/916,989, filed on Dec. 17, 2013.

(51) Int. Cl.

| | |
|---|---|
| ***H01F 27/30*** | (2006.01) |
| ***H01F 27/02*** | (2006.01) |
| ***H01F 27/29*** | (2006.01) |
| ***H01F 27/24*** | (2006.01) |
| ***H01F 27/28*** | (2006.01) |

(52) U.S. Cl.
CPC ..... *H01F 27/29* (2013.01); *H01F 27/24* (2013.01); *H01F 27/2823* (2013.01); *H01F 2027/297* (2013.01)

(58) Field of Classification Search
CPC ..... H01F 5/04; H01F 27/306; H01F 27/325; H01F 5/02
USPC ..... 336/192, 196, 198, 208
See application file for complete search history.

(56) References Cited

U.S. PATENT DOCUMENTS

| | | | | |
|---|---|---|---|---|
| 5,034,854 A * | 7/1991 | Matsumura | H01F 27/292 | 336/192 |
| 6,301,127 B1 * | 10/2001 | Kobayashi | H01F 27/06 | 336/192 |
| 2011/0215892 A1 * | 9/2011 | Kobayashi | H01F 27/29 | 336/192 |

FOREIGN PATENT DOCUMENTS

| | | |
|---|---|---|
| JP | 11273941 A * | 10/1999 |
| JP | 2007080851 A * | 3/2007 |

* cited by examiner

*Primary Examiner* — Tsz Chan
(74) *Attorney, Agent, or Firm* — Patterson Intellectual Property, P.C.; Mark J. Patterson; Jerry Turner Sewell

(57) ABSTRACT

A magnetic device for an electronic circuit includes a bobbin having a bobbin body with an axial passage, a first pin rail, and a second pin rail. A winding can be disposed around the bobbin body. A core can have a core leg extending into the axial passage. The bobbin can be disposed on a printed circuit board. The core and the winding can be elevated off of the printed circuit board. The bobbin can include a first spacing member positioned between the bobbin body and the first pin rail, and a second spacing member positioned between the bobbin body and the second pin rail. The core can be positioned on the first and second spacing members such that the core is at an offset position from the first and second bobbin pin rails. The winding can additionally be offset from the first and second pin rails.

20 Claims, 5 Drawing Sheets

MAGNETIC COMPONENT WITH ELEVATED BOBBIN

A portion of the invention of this patent document contains material that is subject to copyright protection. The copyright owner has no objection to the reproduction of the patent document or the patent invention, as it appears in the U.S. Patent and Trademark Office patent file or records, but otherwise reserves all copyright rights whatsoever.

CROSS-REFERENCES TO RELATED APPLICATIONS

This application claims benefit of U.S. Patent Application No. 61/916,989 filed Dec. 17, 2013 entitled "Magnetic Component with Elevated Bobbin".

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic devices for electronic circuit applications. More particularly, the present invention pertains to a magnetic device that can be used as an inductor or transformer within an electronic circuit.

Magnetic devices for electronic circuits, including inductors and transformers, are known in the art. Conventional magnetic devices can include a magnetic component which can be mounted on a printed circuit board, with the bottom of a winding or coil and a magnetically permeable core of the magnetic component being positioned in close proximity to the printed circuit board. One disadvantage of such a configuration is that other circuit components can be prevented from being connected to the printed circuit board beneath the winding and the core, as space between the winding and the printed circuit board and space between the core and the printed circuit board is limited. Another disadvantage of having the winding and core in close proximity to the printed circuit board is that electrical or magnetic interference can occur between the magnetic component and the printed circuit board, which can be undesirable.

Additionally, in some conventional solutions, the magnetic device can include an enclosure, with a thermal potting material disposed between the winding and the enclosure. With the winding and the magnetic core in close proximity to the printed circuit board, a large amount of thermal potting material can be required to effectively transfer heat from the winding and the magnetic component to the enclosure. Having to use a large amount of potting material can significantly increase the cost of the magnetic device.

What is needed, then, are improvements in magnetic devices for electronic circuit applications.

BRIEF SUMMARY OF THE INVENTION

One aspect of the present invention is a magnetic device for an electronic circuit including a bobbin having a bobbin body with an axial passage and first and second pin rails. A first spacing member can be positioned between the bobbin body and the first pin rail. A second spacing member can be positioned between the bobbin body and the second pin rail. A winding can be disposed around the bobbin body. A core can have a core leg extending into the axial passage in the bobbin body. The core can be offset from the first and second pin rails. In some embodiments, the axial passage can have a first end and a second end. The first spacing member can form a first shelf adjacent the first end of the axial passage, and the second spacing member can form a second shelf adjacent the second end of the axial passage. The core can be positioned on the first and second shelves and offset from the first and second pin rails. As such, the core and effectively the winding can be elevated above or offset from the printed circuit board.

Another aspect of the present invention is a magnetic device for an electronic circuit including a printed circuit board and a bobbin disposed on the printed circuit board. The bobbin can include a bobbin body having an axial passage, the axial passage having a first end and a second end. A first pin rail can be transversely spaced from the axial passage, the first pin rail having a first pin rail surface substantially facing away from the printed circuit board. A second pin rail can be transversely spaced from the axial passage, the second pin rail having a second pin rail surface substantially facing away from the printed circuit board. A winding can be disposed around the bobbin body. A core can have a core leg extending into the axial passage, the core having a core surface substantially facing the printed circuit board. The distance from the printed circuit board to the core surface can be greater than the distance from the printed circuit board to the first pin rail surface and greater than the distance from the printed circuit board to the second pin rail surface. In some embodiments, the winding can have a winding surface substantially facing the printed circuit board. The distance from the printed circuit board to the winding surface can be greater than the distance from the printed circuit board to the first pin rail surface and greater than the distance from the printed circuit board to the second pin rail surface. As such, the core and the winding can be offset from the first and second pin rails, and the printed circuit board.

Another aspect of the present invention includes a magnetic device for an electronic circuit including a printed circuit board and a bobbin disposed on the printed circuit board. The bobbin can include a bobbin body having an axial passage, the axial passage having a first end and a second end. A first pin rail can be positioned below the first end of the axial passage, and a second pin rail can be positioned below the second end of the axial passage. A winding can be disposed around the bobbin body. A core can have a core leg extending into the axial passage, the core having a core surface substantially facing the printed circuit board. The distance between the printed circuit board and the core surface can be greater than or equal to seventy-five percent of the distance between the first and second pin rails. In some embodiments, the winding can have a winding surface substantially facing the printed circuit board, and the distance between the printed circuit board and the winding surface can be greater than or equal to about fifty percent of the distance between the first and second pin rails.

One object of the present invention is to provide a magnetic device having a core elevated or offset from a printed circuit board.

Another object is to provide a magnetic device having a winding elevated or offset from a printed circuit board.

A further object of the present invention is to help reduce magnetic interference between a printed circuit board and a winding on a magnetic component.

Yet another object is to help reduce the amount of thermal potting material required between a winding and an enclosure in a magnetic device.

Numerous other objects, advantages and features of the present invention will be readily apparent to those of skill in the art upon a review of the following drawings and description of a preferred embodiment.

DETAILED DESCRIPTION OF THE INVENTION

Figure 1:
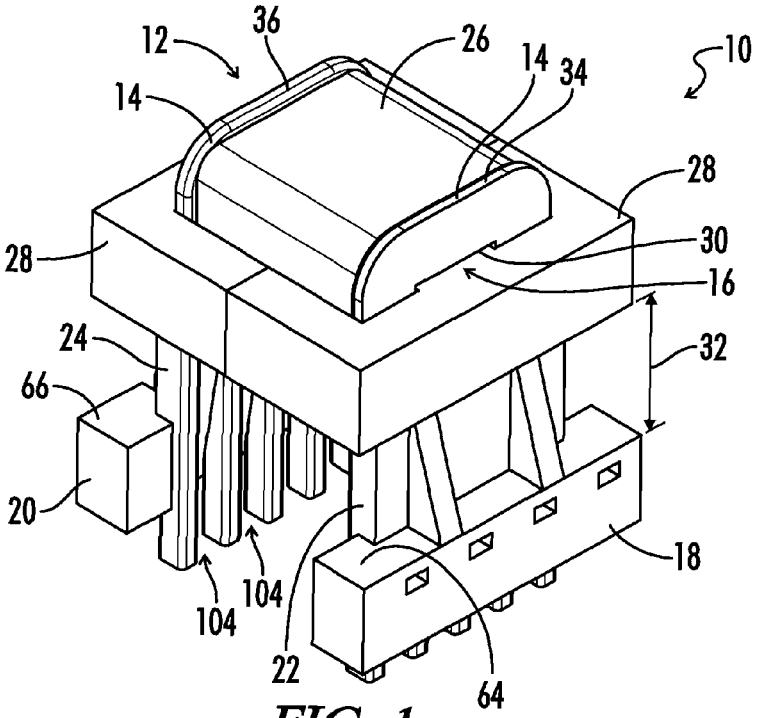
FIG. 1 is a perspective view of an embodiment of a magnetic device in accordance with an aspect of the present invention.

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the apparatuses and/or methods disclosed and claimed herein may be made and/or executed without undue experimentation in light of the present invention. While the apparatuses and methods of this invention have been described in terms of the embodiments included herein, it will be apparent to those of ordinary skill in the art that variations may be applied to the apparatuses and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Figure 3:
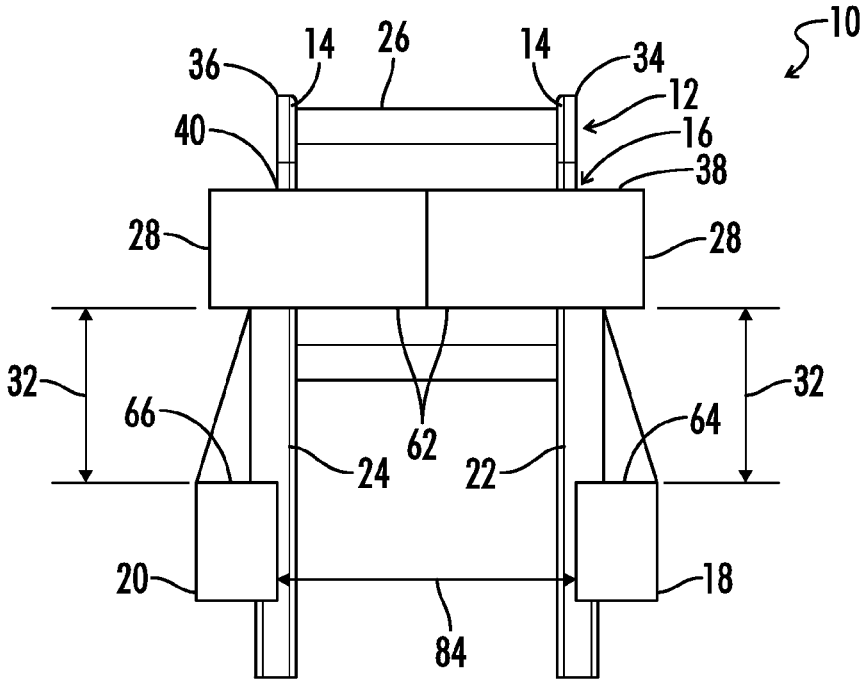
FIG. 3 is a side view of the magnetic device of FIG. 1.

An embodiment of a magnetic device 10 is shown in FIG. 1 and FIG. 3. The magnetic device 10 is shown in an upright position in FIG. 1 and FIG. 3. However, the magnetic device 10 can be placed in a variety of orientations. Directional or orientation terms used hereinafter are used for clarity in describing the orientation shown in FIG. 1, but such directional terms should not be construed as a limitation on the scope of the invention. The magnetic device 10 can include a bobbin 12. The bobbin 12 can have a bobbin body 14 with an axial passage 16. The bobbin 12 can include a first pin rail 18 and a second pin rail 20. A winding 26 can be disposed around the bobbin body 14.

A core 28 can have a core leg 30 extending into the axial passage 16 in the bobbin body 14. In some embodiments, as shown in FIG. 1 and FIG. 3, the core 28 can be offset from the first and second pin rails 18 and 20 by an offset distance 32. The core 28 can include a core surface, shown as a core lower surface 62 in FIG. 3. The first pin rail 18 can include a first pin rail surface, shown as a first pin rail upper surface 64 in FIG. 3. The second pin rail 20 can include a second pin rail surface, shown as a second pin rail upper surface 66 in FIG. 3. The core lower surface 62 in some embodiments can be offset from both the first pin rail upper surface 64 and the second pin rail upper surface 66. In some embodiments, a first spacing member 22 can be positioned between the bobbin body 14 and the first pin rail 18. A second spacing member 24 can be positioned between the bobbin body 14 and the second pin rail 20. The core 28 can then be positioned on or against the first and second spacing members 22 and 24 in order to offset the core from the first and second pin rails 18 and 20.

In some embodiments, the bobbin body 14 can include a first retention flange 34 and a second retention flange 36. The winding 26 can be positioned between the first and second retention flanges 34, 36 such that the winding 26 is retained on the bobbin body 14.

Figure 2:
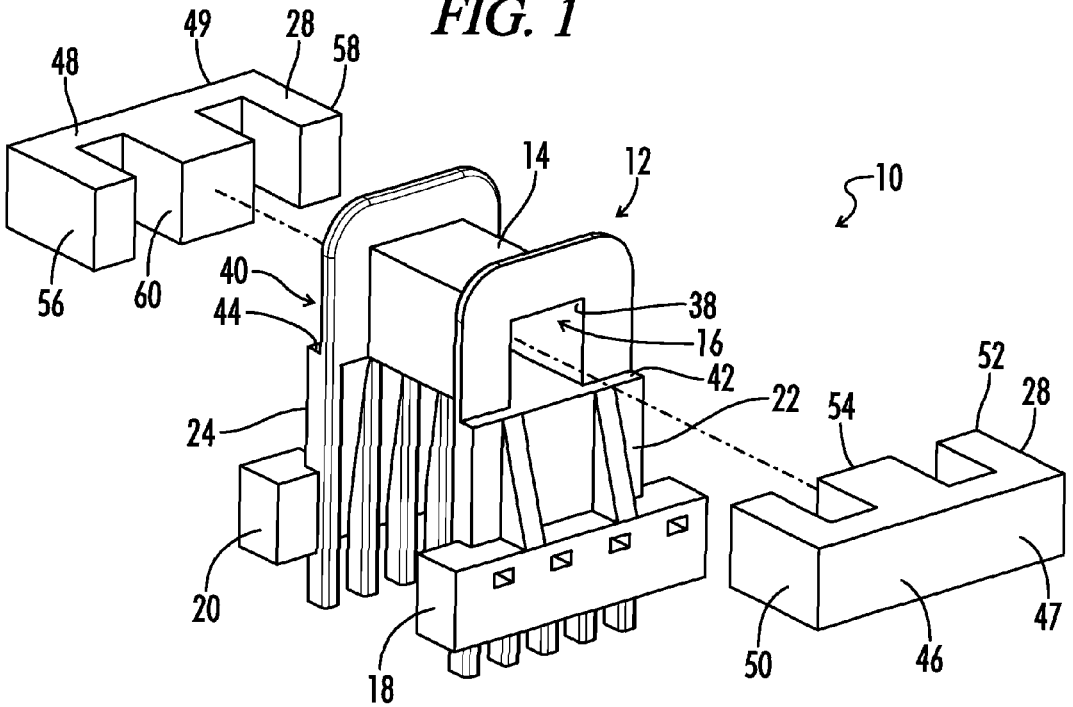
FIG. 2 is a partially exploded view of the magnetic device of FIG. 1.

A partial exploded view of the magnetic device of FIG. 1 is shown in FIG. 2. The axial passage 16 through the bobbin body 14 can include a first end 38 and a second end 40. In some embodiments, the first pin rail 18 can be located below the first end 38 of the axial passage 16, and the second pin rail 20 can be located below the second end 40 of the axial passage 16. In some embodiments, the first spacing member 22 can form a first shelf 42 adjacent the first end 38 of the axial passage 16, and the second spacing member 24 can form a second shelf 44 adjacent the second end 40 of the axial passage 16. The core 28 can then be positioned on or rest on the first and second shelves 42 and 44 such that core 28 can be offset from the first and second pin rails 18 and 20.

In some embodiments, the first and second spacing members 22 and 24 can each be a side wall positioned between the bobbin body 14 and the respective first and second pin rails 18 and 20, as shown in FIG. 2. In other embodiments, the first and second spacing members 22 and 24 can each be one or more spacing legs positioned between the bobbin body 14 and the respective first and second pin rails 18 and 20. As such, the spacing members 22 and 24 can help maintain the core 28 in an offset or elevated position from the first and second pin rails 18 and 20.

The core 28 in FIG. 2 includes a first E-core 46 and a second E-core 48. The first E-core 46 can have a first back wall 47. The first E-core 46 can additionally have E-core first and second outer legs 50 and 52 and a first middle leg 54 extending from the first back wall 47. The second E-core 48 can have a second back wall 49. The second E-core 48 can have second E-core first and second outer legs 56 and 58 and a second middle leg 60 extending from the second back wall 49.

When the first and second E-cores 46 and 48 are inserted into the axial passage 16 of the bobbin body 14, the first middle leg 54 of the first E-core 46 can extend into the first end 38 of the axial passage 16, with the first E-core first and second outer legs 50 and 52 extending on either side of the bobbin body 14. The second middle leg 60 of the second E-core 48 can extend into the second end 40 of the axial passage 16, with the second E-core first and second outer legs 56 and 58 extending on either side of the bobbin body 14. Both E-cores 46 and 48 can be inserted onto the bobbin 12 as described, and corresponding legs of the first and second E-cores 46 and 48 can be mated together to form the overall core 28.

The magnetic device 10 shown in FIG. 2 utilizes two E-cores inserted into the bobbin body 14. However, in other embodiments, any suitable core, or combination of cores, known in the art can be utilized in the magnetic device 10, including, but not limited to, C-cores, I-cores, U-cores, toroidal cores, etc.

In some embodiments, when the first and second E-cores 46 and 48 are inserted into the bobbin body 14, the first back wall 47 can be positioned on or rested on the first shelf 42 and the second back wall 49 can be positioned on or rested on the second shelf 44. As such, the first and second shelves 42 and 44 can help support the first and second E-cores 46 and 48 respectively in an offset or elevated position from the first and second pin rails 18 and 20 respectively.

Figure 4:
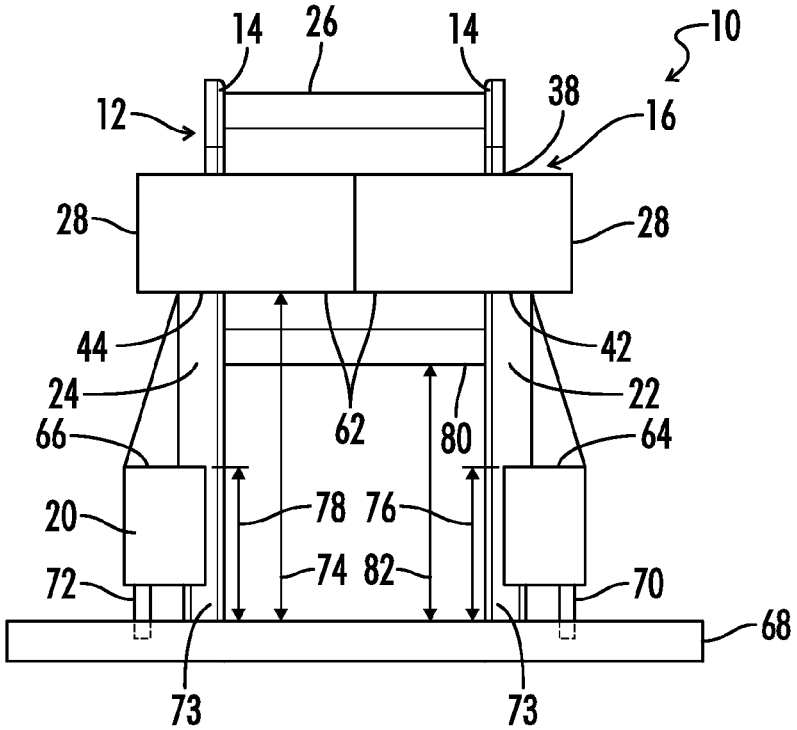
FIG. 4 is a side view of the magnetic device of FIG. 1 including a printed circuit board.

The magnetic device 10 of FIG. 3 is shown in FIG. 4, with the device 10 further including a printed circuit board 68. The bobbin 12 can be disposed on the printed circuit board 68. A first terminal pin 70 can be inserted into the first pin rail 18, and a second terminal pin 72 can be inserted into the second pin rail 20. The first and second terminal pins 70 and 72 can be electrically connected to the printed circuit board 68. The winding 26 can then be electrically connected to the first terminal pin 70 or the second terminal pin 72, or both, to electrically connect the winding 26 to the printed circuit board 68. In some embodiments, the device 10 can include a first row of terminal pins inserted into the first pin rail 18, and a second row of terminal pins inserted into the second pin rail 20.

In some embodiments, the bobbin 12 can include one or more standoffs 73 positioned between the printed circuit board 68 and the first and second pin rails 18 and 20. In some embodiments, the standoffs 73 can be extensions of the first and second spacing members 22 and 24. In other embodiments, the standoffs 73 can independently extend from the first and second pin rails 18 and 20. The standoffs can rest against the printed circuit board 68 when the terminal pins 70 and 72 are electrically connected to the printed circuit board 68 such that the standoffs 73 can help provide support for the bobbin 12 on the printed circuit board 68 and help alleviate pressure or stresses on the terminal pins 70 and 72.

In some embodiments, as shown in FIG. 2 and FIG. 4, the first and second pin rails 18 and 20 can be transversely spaced from the axial passage 16. The pin rails 18 and 20 being transversely spaced from the axial passage 16 can be defined as the pin rails 18 and 20 being spaced in a direction that is transverse to the longitudinal axis of the axial passage 16. The first pin rail surface 64 can substantially face away from the printed circuit board 68. The second pin rail surface 66 can also substantially face away from the printed circuit board 68. In the orientation shown in FIG. 4, the first and second bobbin pin rail surfaces 64 and 66 can be described as the first and second pin rail upper surfaces 64 and 66. The core surface 62 in FIG. 4 is shown substantially facing the printed circuit board 68, and is shown as a core lower surface 62.

In some embodiments, the distance 74 from the printed circuit board 68 to the core surface 62 is greater than the distance 76 from the printed circuit board 68 to the first pin rail surface 64, and the distance 74 is greater than the distance 78 from the printed circuit board 68 to the second pin rail surface 66. Such an orientation can produce the offset distance 32 between the core 28 and the first and second pin rails 18 and 20 shown in FIG. 3.

Referring again to FIG. 4, in some embodiments, the winding 26 can include a winding surface 80 substantially facing the printed circuit board 68. In FIG. 4 the winding surface 80 can be described as a winding lower surface 80. In some embodiments, the distance 82 between the printed circuit board 68 and the winding surface 80 can be greater than the distance 76 between the printed circuit board 68 and the first pin rail surface 64, and the distance 82 can be greater than the distance 78 between the printed circuit board 68 and the second pin rail surface 66. As such, both the core 28 and the winding 26 can be elevated or offset from the first and second pin rails 18 and 20.

Referring to FIGS. 3 and 4, in some embodiments, the distance 74 from the printed circuit board 68 to the core surface 62 can be greater than or equal to about seventy-five percent of the distance 84 between the first and second pin rails 18 and 20. In some embodiments, the distance 82 between the winding surface 80 and the printed circuit board 68 can be greater than or equal to about fifty percent of the distance 84 between the first and second pin rails 18 and 20. In still other embodiments, the distance 74 from the printed circuit board 68 to the core surface 62 can be greater than or equal to the distance 84 between the first and second pin rails 18 and 20. As such, the core 28 and the winding 26 can generally be elevated off of the printed circuit board.

In the embodiments shown in FIG. 3 and FIG. 4, first and second spacing members 22 and 24 are utilized to elevate the core 28 and the winding 26 from the printed circuit board 68. However, there are many other ways that such an elevation of the core 28 and the winding 26 can be achieved. For example, the bobbin pin rails 18 and 20 in some embodiments can be elongated or extended away from the printed circuit board 68 such that the core 28 and the winding 26 can be increasingly elevated off of the printed circuit board 68 without the use of additional spacing members between the bobbin pin rails and the bobbin body. Additionally, the standoffs 73 between the printed circuit board 68 and the first and second pin rails 18 and 20 in some embodiments can be elongated to elevate or offset the core 28 and the winding 26 off of the printed circuit board 68.

Figure 5:
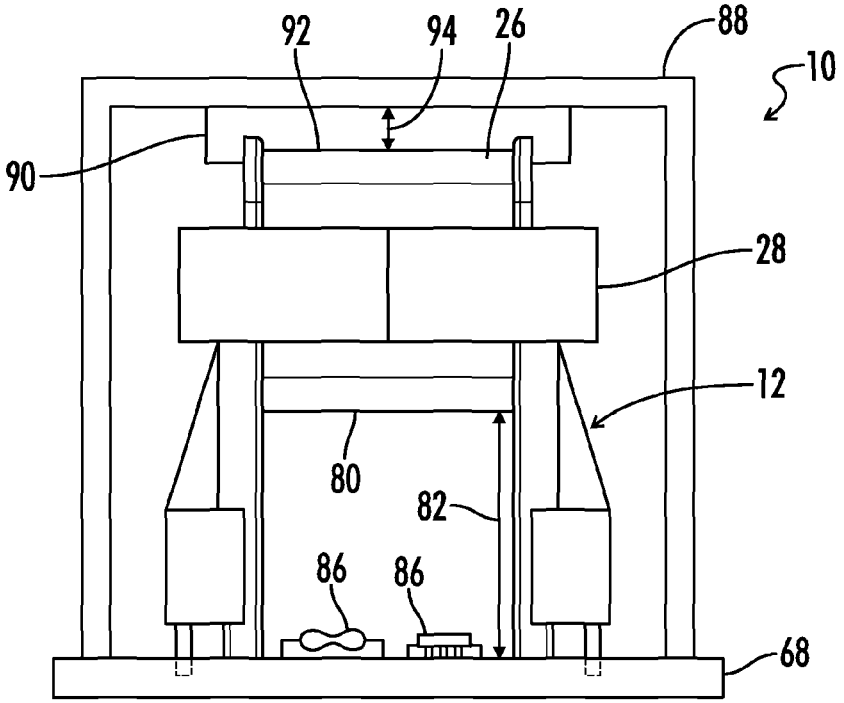
FIG. 5 is a side view of the magnetic device of FIG. 4 including an enclosure.

Having the core 28 and the winding 26 elevated or offset from the printed circuit board 68 can have several benefits. For instance, as shown in FIG. 5, a substantial gap or space can be shown between the winding 26 and the printed circuit board 68. The gap can be larger than conventional magnetic devices, where the winding is relatively close to the printed circuit board. As such, one or more additional circuit components 86 can be electrically connected to the printed circuit board 68 and positioned between the winding 26 and the printed circuit board 68, or directly beneath the winding 26. Accordingly, the space required on the printed circuit board 68 for the overall electronic circuit can be reduced.

Having the winding 26 elevated or offset from the printed circuit board 68 can help reduce electrical or magnetic interference between the winding 26 and the printed circuit board 68, as well as between the winding 68 and other circuit components 86 on the printed circuit board 68.

Additionally, in some embodiments, as shown in FIG. 5, the magnetic device 10 can include an enclosure 88 at least partially covering the bobbin 12, the winding 26, and the core 28. In some embodiments, a thermal potting material 90 can be disposed between the winding 26 and the enclosure 88. The thermal potting material 90 can help transfer heat from the winding 26 to the enclosure 88, which can help increase thermal dissipation of heat away from the winding 26, as well as the other components of the magnetic device 10. In conventional magnetic devices with the winding positioned relatively close to the printed circuit board, there can be substantial gap between the winding and the enclosure, such that a substantial amount of thermal potting material must be used to properly transfer heat between the winding and the enclosure.

In the embodiments shown in FIG. 5, the core 28 and the winding 28 can be elevated from the printed circuit board 68 such that a second winding surface 92 substantially facing the enclosure 88 can be located in close proximity to the enclosure 88, such that the amount of thermal potting material 90 needed for effective heat transfer between the winding 26 and the enclosure 88 can be reduced, which can thereby help reduce the cost of the magnetic device 10. In some embodiments, the distance 82 between the printed circuit board 68 and the winding surface 80 can be less than the distance 94 between the second winding surface 92 and the enclosure 88.

Figure 6:
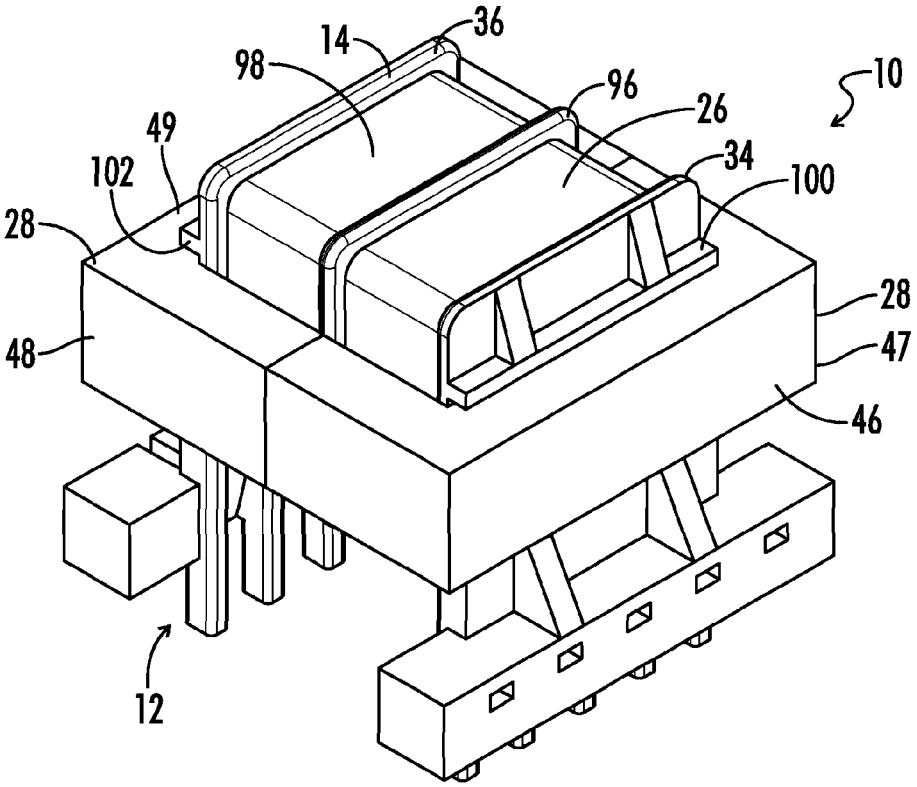
FIG. 6 is a perspective view of another embodiment of a magnetic device having first and second windings.

Another embodiment of a magnetic device 10 is shown in FIG. 6. The device 10 of FIG. 6 is similar to the device 10 of FIG. 1 in many respects, including an elevated core 28 and winding 26. In FIG. 6, the bobbin body 14 of the bobbin 12 includes a first retention flange 34, a second retention flange 36, and a middle retention flange 96. In the embodiment of FIG. 6, the winding 26 is positioned between the first retention flange 34 and the middle retention flange 96. The device 10 of FIG. 6 further includes a second winding 98 disposed between the second retention flange 36 and the middle retention flange 96. As such, more than one winding can be utilized on the magnetic device 10 such that the magnetic device 10 can be utilized as a transformer, or as multiple inductors.

Figure 7:
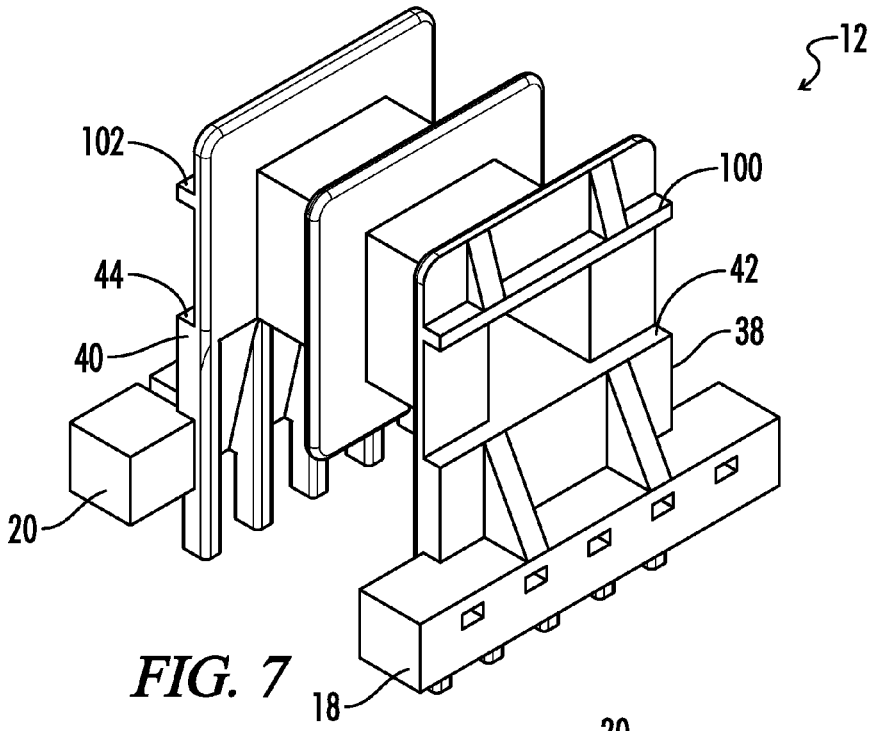
FIG. 7 is a perspective view of a bobbin of the magnetic device of FIG. 6.
Figure 9:
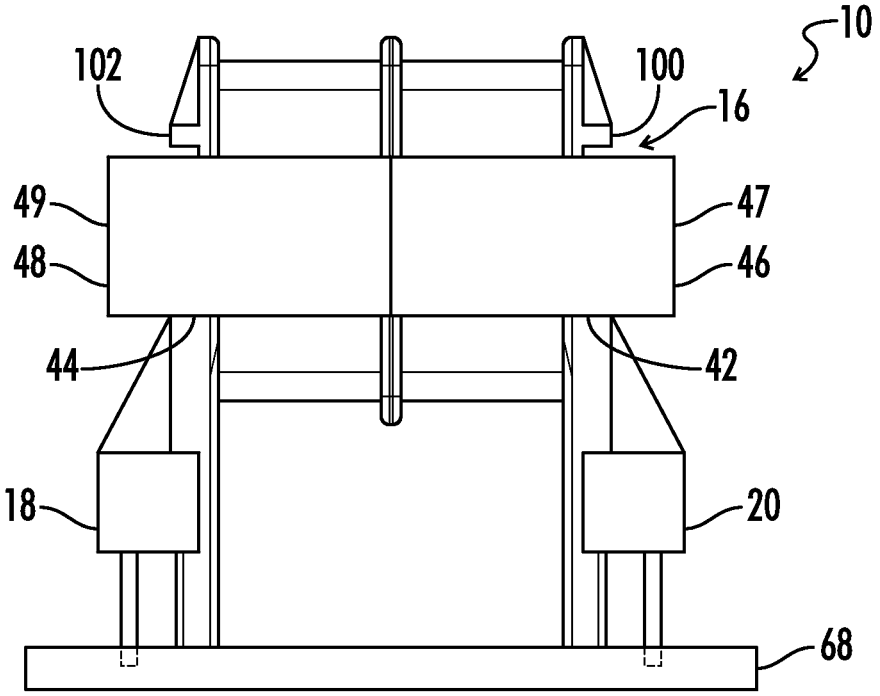
FIG. 9 is a side view of the magnetic device of FIG. 6 including a printed circuit board.

The bobbin 12 of FIG. 6 is shown in FIG. 7. In some embodiments, the bobbin 12 can include a first overhang 100 and a second overhang 102 extending from the bobbin body 12. As shown in FIG. 9, the first back wall 47 of the first E-core 46 can be positioned between the first overhang 100 and the first shelf 42, and the second back wall 49 of the second E-core 48 can be positioned between the second overhang 102 and the second shelf 44. As such, the shelves 42, 44 and the overhangs 100, 102 can help retain the core 28 in a relatively uniform position within the axial passage 16 as the magnetic device 10 is rotated or adjusted into varying orientations.

Figure 8:
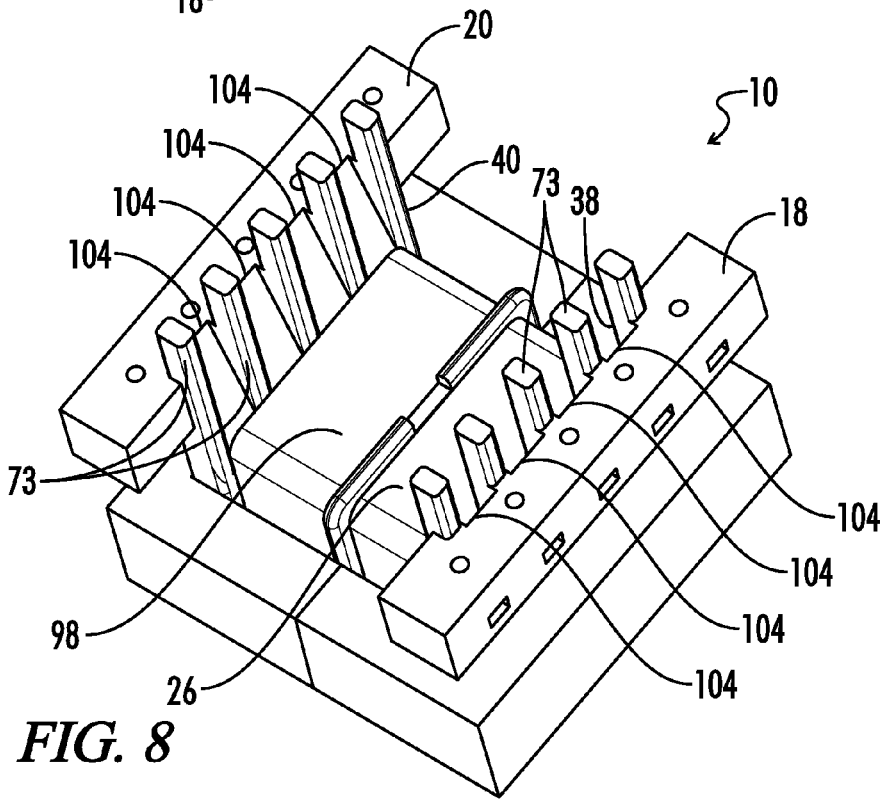
FIG. 8 is a bottom perspective view of the magnetic device of FIG. 6.

A bottom perspective view of the magnetic device 10 of the FIG. 6 is shown in FIG. 8. In some embodiments, the magnetic device 10 can include one or more guide slots 104 in the bobbin 12. Wire from the windings 26 and 98 can be fed through the guide slots 104 and connected to terminal pins on the first and second pin rails 18 and 20. The guide slots 104 can be defined in either the first and second spacing members 38 and 40, the first and second pin rails 18 and 20, or both. The guide slots 104 can make connecting the windings 26 and 98 to the terminal pins easier and more efficient. The standoffs 73 can act as guide posts between the guide slots 104. Similar guide slots 104 can be seen for the magnetic device 10 of FIG. 1.

Thus, although there have been described particular embodiments of the present invention of a new and useful Magnetic Component With Elevated Bobbin it is not intended that such references be construed as limitations upon the scope of this invention except as set forth in the following claims.

What is claimed is:

1. A magnetic device for an electronic circuit comprising:

a bobbin comprising a bobbin body having an axial passage, a first pin rail and a second pin rail, each pin rail having a respective upper surface facing toward the axial passage of the bobbin body, the first pin rail spaced apart from the second pin rail by a pin rail spacing distance, a first spacing member positioned between the bobbin body and the upper surface of the first pin rail, a second spacing member positioned between the bobbin body and the upper surface of the second pin rail, and a winding disposed around the bobbin body;

a printed circuit board having an upper surface positioned below the first and second pin rails; and a core having a core leg extending into the axial passage in the bobbin body, the core having a lower surface facing the upper surfaces of the first and second pin rails, the lower surface of the core being offset from the first and second pin rails by a first core offset distance, the lower surface of the core being offset from the upper surface of the printed circuit board by a second core offset distance, the second core offset distance being at least seventy-five percent of the pin rail spacing distance.

2. The magnetic device of claim 1, wherein:

the axial passage has a first end and a second end;

the first spacing member forms a first shelf adjacent the first end of the axial passage;

the second spacing member forms a second shelf adjacent the second end of the axial passage; and the core is positioned on the first and second shelves.

3. The magnetic device of claim 2, wherein:

the core further comprises a first E-core and a second E-core, the first E-core having a first back wall and a first middle core leg extending from the first back wall into the first end of the axial passage, the second E-core having a second back wall and a second middle core leg extending from the second back wall into the second end of the axial passage;

the first back wall of the first E-core rests on the first shelf; and the second back wall of the second E-core rests on the second shelf.

4. The magnetic device of claim 3, wherein:

the bobbin further comprises a first overhang and a second overhang extending from the bobbin body;

the first back wall of the first E-core is positioned between the first overhang and the first shelf; and the second back wall of the second E-core is positioned between the second overhang and the second shelf.

5. The magnetic device of claim 1, wherein:

the first pin rail includes a first pin rail upper surface;

the second pin rail includes a second pin rail upper surface; and the core lower surface is offset from both the first pin rail upper surface and the second pin rail upper surface.

6. The magnetic device of claim 1, further comprising:

a first terminal pin inserted into the first pin rail; and a second terminal pin inserted into the second pin rail, wherein the first and second terminal pins are electrically connected to the printed circuit board.

7. The magnetic device of claim 6, further comprising an enclosure at least partially covering the bobbin, the winding, and the core.

8. The magnetic device of claim 1, wherein the bobbin body further comprises a first retention flange and a second retention flange, and wherein the winding is disposed between the first retention flange and the second retention flange.

9. The magnetic device of claim 1, wherein:

the bobbin body further comprises a first retention flange, a second retention flange, and a middle retention flange, the winding disposed between the first retention flange and the middle retention flange; and the device further comprises a second winding disposed between the middle retention flange and the second retention flange.

10. A magnetic device for an electronic circuit comprising:

a printed circuit board having an upper surface;

a bobbin disposed on the printed circuit board, the bobbin comprising a bobbin body having an axial passage, a first pin rail transversely spaced from the axial passage, the first pin rail having a first pin rail surface substantially facing away from the upper surface of the printed circuit board, and a second pin rail transversely spaced from the axial passage, the second pin rail having a second pin rail surface substantially facing away from the printed circuit board, the second pin rail spaced apart from the first pin rail by pin rail spacing distance;

a winding disposed around the bobbin body; and a core having a core leg extending into the axial passage, the core having a lower core surface substantially facing the upper surface of the printed circuit board, a distance from the upper surface of the printed circuit board to the lower core surface being greater than a distance from the upper surface of the printed circuit board to the first pin rail surface and greater than a distance from the upper surface of the printed circuit board to the second pin rail surface, the distance from the upper surface of the printed circuit board to the lower core surface being at least seventy-five percent of the pin rail spacing distance between the first and second pin rails.

11. The magnetic device of claim 10, wherein the winding further comprises a winding surface substantially facing the upper surface of the printed circuit board, a distance from the upper surface of the printed circuit board to the winding surface being greater than the distance from the upper surface of the printed circuit board to the first pin rail surface and greater than the distance from the upper surface of the printed circuit board to the second pin rail surface, the distance from the upper surface of the printed circuit board to the winding surface being at least fifty percent of the pin rail spacing distance between the first pin rail and the second pin rail.

12. The magnetic device of claim 10, further comprising an enclosure at least partially covering the bobbin, the winding, and the core.

13. The magnetic device of claim 12, further comprising a thermal potting material disposed between the winding and the enclosure.

14. The magnetic device of claim 12, wherein:

the winding includes a first winding surface facing the upper surface of the printed circuit board and a second winding surface facing the enclosure; and a distance between the first winding surface and the upper surface of the printed circuit board is greater than a distance between the second winding surface and the enclosure.

15. The magnetic device of claim 10, further comprising:

a first spacing member positioned between the first pin rail and the bobbin body, the first spacing member forming a first shelf adjacent the first end of the axial passage;

a second spacing member positioned between the second pin rail and the bobbin body, the second spacing member forming a second shelf adjacent the second end of the axial passage; and the core is positioned on the first and second shelves such that the core is offset from the first and second pin rails.

16. The magnetic device of claim 10, further comprising at least one circuit component electrically connected to the printed circuit board and positioned between the printed circuit board and the winding.

17. A magnetic device for an electronic circuit comprising:

a printed circuit board having an upper surface;

a bobbin disposed on the printed circuit board, the bobbin comprising a bobbin body having an axial passage having a first end and a second end, a first pin rail located below the first end of the axial passage, and a second pin rail disposed below the second end of the axial passage, the second pin rail spaced apart from the first pin rail by a pin rail spacing distance;

a winding disposed around the bobbin body; and a core having a core leg extending into the axial passage, the core having a lower core surface substantially facing the upper surface of the printed circuit board;

wherein a distance between the upper surface of the printed circuit board and the lower core surface is at least seventy-five percent of the pin rail spacing distance between the first and second pin rails.

18. The magnetic device of claim 17, wherein the winding includes a winding surface facing the upper surface of the printed circuit board, and wherein a distance between the upper surface of the printed circuit board and the winding surface is at least fifty percent of the pin rail spacing distance between the first and second pin rails.

19. The magnetic device of claim 17, wherein the distance between the upper surface of the printed circuit board and the lower core surface is greater than or equal to the pin rail spacing distance between the first and second pin rails.

20. The magnetic device of claim 17, further comprising a first spacing member positioned between the first pin rail and the bobbin body, the first spacing member forming a first shelf adjacent the first end of the axial passage; and a second spacing member positioned between the second pin rail and the bobbin body, the second spacing member forming a second shelf adjacent the second end of the axial passage, wherein the core is positioned against the first and second shelves such that the core is offset from the first and second pin rails.

* * * * *